US010721960B2

(12) United States Patent
Buhl et al.

(10) Patent No.: US 10,721,960 B2
(45) Date of Patent: Jul. 28, 2020

(54) DOUBLE-LAYERED TUBE OF THE TOBACCO PROCESSING INDUSTRY AND METHOD FOR PRODUCING SUCH A TUBE

(71) Applicant: HAUNI MASCHINENBAU GMBH, Hamburg (DE)

(72) Inventors: Alexander Buhl, Blowatz (DE); Roman Piechaczek, Geesthacht (DE); Jan Blewonska, Lueneburg (DE); Stefan Knobbe, Bad Segeberg (DE); Kevin Brast, Nuremberg (DE); Ralf Soltow, Reinbek (DE); Felix Luecke, Hamburg (DE); Gerd Strohecker, Marschacht (DE)

(73) Assignee: HAUNI Maschinenbau GmbH, Hamburg (DE)

( * ) Notice: Subject to any disclaimer, the term of this patent is extended or adjusted under 35 U.S.C. 154(b) by 112 days.

(21) Appl. No.: 15/837,557

(22) Filed: Dec. 11, 2017

(65) Prior Publication Data

US 2018/0160725 A1 Jun. 14, 2018

(30) Foreign Application Priority Data

Dec. 12, 2016 (DE) ..... 10 2016 124 051

(51) Int. Cl.

| | |
|---|---|
| ***A24D 3/02*** | (2006.01) |
| ***A24D 1/02*** | (2006.01) |
| ***A24C 5/46*** | (2006.01) |

(52) U.S. Cl.

CPC ..... *A24D 3/0229* (2013.01); *A24C 5/46* (2013.01); *A24D 1/025* (2013.01)

(58) Field of Classification Search

CPC ..... A24D 3/0229; A24D 1/025; A24D 1/00; A24D 1/045; A24D 3/0291; B65D 2577/2025; B32B 27/10; B29L 2009/00

USPC ..... 229/87.14; 131/280, 202, 360, 365, 58; 162/139; 206/245

See application file for complete search history.

(56) References Cited

U.S. PATENT DOCUMENTS

| | | | | |
|---|---|---|---|---|
| 1,490,808 | A * | 4/1924 | Dunhill | A24D 1/14 131/348 |
| 1,897,692 | A * | 2/1933 | De Voe | B65D 75/38 206/247 |
| 4,091,843 | A * | 5/1978 | Mikes | B29D 23/001 138/127 |
| 4,564,030 | A * | 1/1986 | Jessup | A24D 3/043 131/336 |
| 7,243,659 | B1 | 7/2007 | Lecoultre et al. | |
| 2010/0242977 | A1 | 9/2010 | Tarora et al. | |
| 2013/0206152 | A1 * | 8/2013 | Garcia Urbano | A24D 1/045 131/281 |

(Continued)

FOREIGN PATENT DOCUMENTS

| | | |
|---|---|---|
| DE | 25 56 332 | 10/1976 |
| EP | 2 974 798 | 1/2016 |
| EP | 3 033 952 | 6/2016 |

*Primary Examiner* — Christopher R Demeree

(74) *Attorney, Agent, or Firm* — Greenblum & Bernstein, P.L.C.

(57) ABSTRACT

The invention relates to a double-layered tube of the tobacco processing industry and a method for producing such a tube. When applying a positioning adhesive, it is provided to apply said adhesive with an application thickness of 10 μm to 80 μm.

22 Claims, 3 Drawing Sheets

(56) References Cited

U.S. PATENT DOCUMENTS

| | | | | |
|---|---|---|---|---|
| 2014/0103099 | A1* | 4/2014 | Snow | A24D 1/025<br>229/87.14 |
| 2015/0157052 | A1* | 6/2015 | Ademe | A24F 47/006<br>131/58 |

* cited by examiner

DOUBLE-LAYERED TUBE OF THE TOBACCO PROCESSING INDUSTRY AND METHOD FOR PRODUCING SUCH A TUBE

CROSS-REFERENCE TO RELATED APPLICATIONS

The present application claims priority under 35 U.S.C. § 119(a) of Gelman Patent Application No. 10 2016 124 051.6 filed Dec. 12, 2016, the disclosure of which is expressly incorporated by reference herein in its entirety.

BACKGROUND

1. Field of the Invention

The invention relates to a double-layered tube of the tobacco processing industry and a method for producing double-layered tubes of the tobacco processing industry.

2. Discussion of Background Information

In the tobacco processing industry, tubes, for example cardboard tubes or paper tubes, are used in order to provide specific filters, for example, such as a recess filter or a hollow filter. Additionally, such tubes also serve as a component of a diffuser which ensures that a nicotine-containing smoke is homogenized. A corresponding tube is designed to have a certain degree of stability which is why it is known to produce multi-walled paper tubes.

A method and a machine for producing a multi-walled paper tube for smoking article-mouthpiece sleeves are disclosed in DE 25 56 332 A1, the disclosure of which is expressly incorporated by reference in its entirety. In DE 25 56 332, a continuous paper strip, the width thereof corresponding at least to double the circumference of the tube to be produced, is continuously drawn off a roller. The strip is provided in the longitudinal direction with a fold line by weakened portions, by which the strip is divided into two strip portions. The two strip portions are folded up along the fold line and the folded-up strip is shaped to form a double-walled tube. In this case, a connection of the ends of the paper strip is produced by overlapping or underlapping the paper strip with the folded and bent edge.

EP 3 033 952 A2, the disclosure of which is expressly incorporated by reference in its entirety, discloses a double-layered tube of the tobacco processing industry and an apparatus and a method for producing such a tube.

SUMMARY

Embodiments of the present invention increase the quality of correspondingly produced multi-layered tubes and describe a method by which the quality of a tube which is produced may be improved.

According to embodiments, a double-layered tube of the tobacco processing industry is produced from a first and a second material strip portion. The first material strip portion has a first width and the second material strip portion has a second width. The first and the second material strip portions are wound around one another such that the first material strip portion in cross section is shaped to be circular or oval and the edges defining the first width abut one another and the second material strip portion in cross section is shaped to be circular or oval and the edges defining the second width abut one another. The second material strip portion is arranged externally around the first material strip portion and the abutting edges of the first and second material strip portions are offset to one another in the circumferential direction. The thickness of the first and second material strip portions ranges from 38 μm to 160 μm. A positioning adhesive is provided between the first and second material strip portions as glue over the entire surface or approximately over the entire surface with an application thickness of 10 μm to 80 μm.

It has been surprisingly shown that by combining a corresponding thickness according to the invention of the material strip portion with an application thickness according to the invention of the positioning adhesive as the glue, double-layered tubes of high quality are provided over a long period of time.

By the double-layered tube according to the invention of the tobacco processing industry, the edges of the first and the second material strip portions which are arranged so as to abut one another at these transition points have a very good predeterminable roundness. In this way, the quality of the double-layered tube which is produced is considerably improved in comparison with the prior art.

"Application thickness" within the scope of the invention is understood as the thickness of the adhesive which is present during the application thereof. To this end, for example, reference is made to EP 2 974 798 A1, which produces a bead of adhesive or respectively bead of glue of a predeterminable thickness. By way of an apparatus described herein for applying a bead of glue or respectively bead of adhesive onto a wrapping strip of a stick-shaped product of the tobacco processing industry, it is possible to achieve a very accurately defined application thickness of a bead of glue or respectively of an adhesive application. The subject of EP 2 974 798 A1 is expressly incorporated by reference herein in its entirety.

The positioning adhesive within the scope of the invention is the adhesive which is arranged between the first and second material strip portions or respectively a first and a second material strip which, after the first and second material strips have been combined so as to be offset to one another, provides an overlap of the first and second material strips. With reference to the first and second material strip portions, the positioning adhesive may be regarded as the adhesive which is arranged on the larger circumferential portion between the abutting edges. A so-called seam adhesive is provided on the smaller circumferential portion between the abutting edges.

The application thickness of the adhesive, in particular of the positioning adhesive and also of the seam adhesive, does not correspond to the thickness of the adhesive after the material strips have been joined together or respectively the double-layered tube is finished. This is firstly because the adhesive is cured and secondly because adhesive is also absorbed into the material strip.

Preferably, the thickness of the first and second material strip portions ranges from 100 μm to 140 μm, in particular 120 μm to 130 μm, and/or the application thickness of the positioning adhesive ranges from 10 μm to 40 μm, in particular 15 μm to 30 μm.

Preferably, a seam adhesive is provided between the first and second material portions, in particular as glue over the entire surface or approximately over the entire surface, with an application thickness of 40 μm to 120 μm, in particular 60 μm to 100 μm.

Preferably, the application thickness of the seam adhesive is greater than the application thickness of the positioning adhesive. In particular, it is provided that the thickness of the seam adhesive is 1.5 to 3 times as thick as the application thickness of the positioning adhesive.

Preferably, the weight of the first and/or second material strip portion ranges from 27 g/m$^2$ to 125 g/m$^2$, in particular 60 g/m$^2$ to 120 g/m$^2$, in particular 70 g/m$^2$ to 110 g/m$^2$. Particularly preferably, the weight of the first and/or the second material strip portion or respectively the first and/or second material strip is 100 g/m$^2$.

Preferably, the offset of the abutting edges of the first and second material strip portions is between 0.5 mm to 3 mm, in particular between 1.5 mm to 2.5 mm.

Preferably, the ratio of the second width to the first width is between 52 to 48 and 50.5 to 49.5. The ratio of the second width to the first width or respectively the material strip portion widths to one another may be dependent on the format of the product of the tobacco processing industry which is intended to be provided with the tube. For example, with a microslim cigarette with an external diameter of 4.5 mm the ratio of the second width to the first width ranges from 51.5 to 48.5. In a superslim cigarette with an external diameter of, for example 5.3 mm, this ratio may be 51.5 to 48.9 and with a kingsize cigarette with an external diameter of 7.4 mm this ratio may be 50.5 to 49.5.

Preferably, an internal abutment of 0.0 mm is provided, said internal abutment being located between the edges of the first material strip portion, and an external abutment of 0.0 mm to 0.4 mm is provided between the edges of the external material strip portion.

The width of the material portion or respectively the material portions, depending on the format, may be 26.5 mm to 27.5 mm, 31.0 to 32.5 mm and 44.5 mm to 45.5 mm. The material portions or respectively material strips may be made of paper which has the corresponding thickness and the corresponding weight as specified above. The paper may be colored on one side or on both sides, patches, for example made of aluminum or other materials, may be applied or the paper may be metalized with a material, for example, an aluminum backing may be provided. Stamping or printing or punching may also be provided. One adhesive type or even a plurality of adhesive types, for example two, may be provided as adhesive. In particular, a PVA adhesive (polyvinyl acetate adhesive) may be provided and/or optionally included in a further hot melt adhesive. Additionally, a flavor may be applied, preferably onto the first material strip portion. Preferably, the flavor may be added to the adhesive.

The quantities of adhesive or respectively the quantities of glue in the seam adhesive may also be dependent on the format. For example with a microslim cigarette 6 g/500 m to 20 g/500 m, preferably 10 g/500 m of seam adhesive may be provided and with a superslim cigarette or respectively kingsize cigarette 25 g/500 m to 55 g/500 m, preferably 45 g/500 m, of adhesive may be provided per bead of seam glue.

The quantities of adhesive of the positioning adhesive may also be adapted according to the cigarette format. Thus, for example, with a microslim cigarette a quantity of glue of 10 g/500 m to 60 g/500 m, preferably 20 g/500 m may be provided, in a superslim cigarette a quantity of glue of 25 g/500 m to 70 g/500 m, preferably 60 g/500 m, may be provided and with a kingsize cigarette a quantity of glue of 35 g/500 m to 80 g/500 m, preferably 55 g/500 m may be provided.

The pattern of the glue application is preferably over the entire surface.

The adhesive may, for example, be polyvinyl acetate (PVA or PVAC). In this case it is a thermoplastics material. Other adhesives or glues may also be used.

According to the invention, between the first and the second material strip portions an adhesive is provided substantially over the entire surface or over the entire surface. By "gluing over approximately the entire surface" is understood, in particular, as gluing in which the surface of a material strip portion is glued at least 80%, preferably at least 90%, in particular preferably at least 95% over the entire surface.

Within the scope of the invention, an abutment of the edges of the respective material strip portion means that these edges abut one another or have a small spacing from one another.

Preferably, adhesive is provided between at least two edges, in particular the front faces of the edges. In particular, adhesive may be provided in order to fill a gap between the edges.

It is particularly preferred if adhesive is provided between all edges. The gap potentially present between the edges is thus preferably also filled with adhesive. The thickness of the filling in this case is such that the adhesive is preferably aligned with the surface of the material strip portion.

Preferably, the first width of the material strip portions is smaller than the second width. By this measure it is possible to provide a double-layered tube which, in particular in the outer layer, has a small gap or no gap between the edges or respectively the abutting edges.

Preferably, the first and/or the second material strip portion is made of paper or cardboard.

A particularly stable double-layered tube of the tobacco processing industry may be achieved when the abutting edges of the first and second material strip portions are preferably not aligned radially or respectively are not aligned radially to one another. This means that the abutting edges of the first and second material strip portions are offset to one another in the circumferential direction. The abutting edges or respectively the corresponding gaps between the abutting edges are then located with a radial angular spacing from one another. The radial angular spacing is preferably between 2° and 80°, in particular between 5° and 45°, particularly preferably between 10° and 45°.

Preferably, the thickness of the first material strip portion corresponds to the thickness of the second material strip portion. In this case, the quality of the tube produced is particularly high.

In the case where the thickness of the second material strip portion is smaller than the thickness of the first material strip portion, it may be ensured that the adhesive which is used sets more rapidly so that the production speed may be increased.

An apparatus for producing double-layered tubes of the tobacco processing industry can include: a material strip supply apparatus, a cutting apparatus for the longitudinal axial cutting of a base material strip in a first material strip having a first width and a second material strip having a second width, a gluing apparatus by means of which the first and/or second material strip is able to be glued, a combining apparatus by means of which the first and the second material strips are combined with one another such that the first and the second material strips are superimposed so as to be offset to one another, and a formatting apparatus in which a tubular rod is produced from the combined first and second material strips.

The material strip supply apparatus may be supply rollers via which a material strip having a corresponding width may be conveyed. Conventionally, such a material strip is drawn up from a material strip bobbin and conveyed into the corresponding apparatus.

The cutting apparatus which follows the material strip in the direction of conveyance is a longitudinal cutter which cuts the material strip in the longitudinal direction.

The gluing apparatus following the cutting apparatus glues at least one of the two material strips, i.e. the first and/or the second material strip substantially over the entire surface. At this point, a region may also be glued which is able to serve as a seam, i.e., in which an end portion of the second material strip is pressed onto the first material strip for closing a seam in a downstream formatting apparatus. In a subsequent step, however, this region may also be correspondingly glued or respectively may be provided with adhesive. The gluing apparatus may be a gluing apparatus which corresponds to a gluing apparatus which is disclosed in EP 2 974 798 A1.

In the direction of conveyance, a combining apparatus follows the gluing apparatus, within the scope of the invention said combining apparatus preferably comprising a paper position displacing apparatus or respectively paper position adjusting apparatus, by which the lateral position, i.e., a relative position of the first and the second material strips to one another and namely transversely to the direction of conveyance, may be adjusted in order to provide only a partial overlap of the first and the second material strips so that, viewed from the width of these material strips, a portion protrudes to the left and a portion protrudes to the right.

The apparatus for producing double-layered tubes of the tobacco processing industry initially produces a tubular rod from at least two layers of a material strip. This tubular rod may then subsequently be cut to length, for example by a conventional cutting apparatus. Also, it may be initially provided to supply the produced tubular rod to a further machine, for example a filter rod-making machine or a tobacco rod-making machine in order to introduce a filter material or respectively filter segment and/or a tobacco material or respectively tobacco segment around the tubular rod and/or into the tubular rod. At the end, a wrapping material strip may then be wound around the rod thus formed, in order subsequently to cut to length the corresponding sticks with the double-layered tubes contained therein.

Additionally, a separating apparatus is provided, said separating apparatus spatially separating the first material strip or the second material strip from the respective other material strip in the direction of conveyance downstream of the cutting apparatus. As a result, a very accurate positioning and combining of the first and the second material strips may take place so that the relative lateral position to one another may be adjusted accurately. Additionally, in this case a neater gluing of just one material strip is also permitted.

In this case, it is preferred in particular if a first surface of the first material strip and a first surface of the second material strip, which face in the same direction, still face in the same direction after the first and second material strips have been joined together. Alternatively, it may also be provided to rotate the first and the second material strips relative to one another by 180° after the cutting, so that a first surface which is present before the cutting, which is cut into two first surfaces with the same orientation, is joined such that the first surfaces of the first and second material strips are arranged relative to one another.

Moreover, a first heating apparatus is provided between the combining apparatus and the formatting apparatus. Via the first heating apparatus the adhesive may be pre-cured, so that the first and the second material strips are held together and are still able to be shaped and namely preferably such that the shape is substantially held without assistance after being twisted.

Preferably, the gluing apparatus provides a gluing of the first and/or the second material strip over the entire surface or approximately over the entire surface.

Preferably, a seam gluing apparatus is provided between the combining apparatus and the formatting apparatus, in particular between the first heating apparatus and the formatting apparatus. The seam gluing apparatus is used when the previous gluing apparatus does not provide gluing over the entire surface. This refers to the gluing which has not been undertaken in the transverse axial direction over the entire surface, and thus a glue or respectively an adhesive is applied only by the seam gluing apparatus which serves for closing the seam. Complete gluing is preferably designed to be carried out transversely to the longitudinal axis by the gluing apparatus and also the seam gluing apparatus.

Preferably, the formatting apparatus comprises a second heating apparatus. The second heating apparatus may be arranged, for example, in the upper formatting unit of the formatting apparatus and preferably serves, in particular, for the complete setting of the seam adhesive.

An alternative variant may also be provided, for example to arrange the apparatus, which is shown, upstream of a conventional rod-making machine and to use a conventionally used sealer as a further heating apparatus in the conventional rod-making machine. In this preferred embodiment of a corresponding machine of the tobacco processing industry, with a considerably improved operational reliability, a corresponding tubular rod and thus a corresponding double-layered tube of the tobacco processing industry may be produced.

An apparatus for cutting to length may be provided downstream of the formatting apparatus in order to cut to length tubes from the tubular rod.

As mentioned above, a machine of the tobacco processing industry is provided with an apparatus according to the invention, wherein a rod-making machine is arranged downstream of the apparatus according to the invention.

According to embodiments, a method for producing double-layered tubes of the tobacco processing industry includes: conveying a base material strip in the longitudinal axial direction of conveyance, longitudinal axial cutting of the base material strip into a first material strip having a first width and a second material strip having a second width, gluing at least the second material strip, combining the first and the second material strips so as to be offset to one another and so that the first and the second material strips are superimposed, wherein in the region in which the first and the second material strips are adhesively bonded together by being combined so as to be offset to one another, a positioning adhesive with an application thickness of between 10 μm and 80 μm, in particular between 10 μm and 40 μm, in particular between 15 μm and 30 μm, is applied during the gluing, shaping the superimposed material strips into a tubular rod and cutting the rod to length into double-layered tubes.

Preferably, the gluing is carried out over the entire surface or approximately over the entire surface. The gluing on the surface may be interrupted, for example, where a seam of the other wrapping material strip is located. In particular, the glue may be interrupted where a gap is located between the adjacent wrapping material strip or the adjacent first or second material strip, and namely between the edges or respectively abutting edges of the respective material strip.

At this point, however, gluing may also be provided so that the entire surface is actually glued.

Preferably, "combining so as to be offset to one another" means an adhesive bonding which is offset within the width of the strips to one another.

Preferably, one or two regions is or are provided on the second material strip with a seam adhesive having an application thickness of 40 μm to 120 μm, in particular 60 μm to 100 μm.

Preferably, the first material strip is narrower than the second material strip, wherein the second material strip is to be or is arranged externally around the first material strip. Further, a ratio of a second width of the second material strip to a first width of the first material strip is between 52 to 48 and 50.5 to 49.5.

Preferably, a type of adhesive is used for the positioning adhesive and a different type of adhesive is used for the seam adhesive. Also, a type of adhesive may be provided both for the positioning adhesive and the seam adhesive.

Preferably, the combined material strips are heated during and/or after the shaping. As a result, in particular, the adhesive cures completely.

Preferably, the seam adhesive is applied before combining the material strips. The seam adhesive may thus be applied together with the positioning adhesive or respectively may be applied simultaneously therewith, i.e., before combining the material strips. Alternatively, this may occur after combining the material strips or both before and thereafter. In the last variant, a first seam adhesive may be applied at the moment when the positioning adhesive is applied and a further or additional seam adhesive application may take place when the material strips have been combined.

Preferably, multi-layered, in particular double-layered, tubes made of material strip portions which are preferably made of cardboard or paper, are produced, in which no overlapping seams occur. As a result, tubes are produced or respectively provided with a very uniform thickness, whereby very high-quality double-layered tubes of the tobacco processing industry are possible. Due to the lack of seam overlapping, a high level of roundness is achieved. The double-layered tube is produced from a paper strip which is preferably approximately double the width, and namely in comparison with the circumference of the tube. The paper strip is cut longitudinally into two strips of slightly different widths and the two paper strips produced are subsequently guided on separate paths and preferably the wider and subsequently externally located strip is glued. Preferably, all beads of glue are applied at the same time. The two paper strips are then superimposed and the superimposed paper strips supplied to the formatting unit of a formatting apparatus, in order to form therefrom a tubular rod and to close the seam.

Preferably, the disclosed apparatus is a component of a modular insertion apparatus which, for example, may be preferably arranged between a rod-making machine of the tobacco processing industry and a filter tow preparation machine.

Whilst the tubular rod is produced from double-layered material strips, a correspondingly prepared filter tow is conveyed by a corresponding insertion apparatus and above the formatting apparatus and introduced into an intake region of the rod-making machine.

The tubular rod is also introduced into the intake region so that the filter tow, for example, may be introduced around or into the tubular rod in order to be able to produce filter sticks in this manner.

It may also be provided that no further filter tow material is used but the rod-making machine serves to produce a triple-layered tube. In this case, the third layer is supplied as a third material strip via a paper run to the rod-making machine in the inlet region or intake of the formatting apparatus. In the paper run upstream of the formatting apparatus, the third material strip in particular is glued over the entire surface and wound in abutment around the tubular rod, i.e., after the tubular rod has already been produced. In this case, the abutting edges of the abutment of the third material strip are at least offset relative to the abutting edge of the second material strip. The third material strip may be made of a different material from the first and the second material strips. For example, the third material strip may be made of paper, film, crimped paper, electrically conductive material or tobacco sheet.

A two-rod filter tow preparation apparatus could also be used in order to produce a coaxial filter from the double-layered tube or respectively the double-layered tubular rod. A filter tow rod is then arranged around the double-layered tubular rod and the other filter tow rod is introduced into the tubular rod. Thus, a coaxial filter may be produced after a corresponding cutting to length into double-layered tubes. To this end, for example an anchoring seam in the form of an adhesive is applied onto the produced tubular rod made of double-layered material strips, so that the filter tow is also held on the tubular rod. During the production of the coaxial filter it is possible for the first filter material and the second filter material to be different from one another.

Preferably, a double-layered tube, which in the present case is described according to the invention or in a preferred manner, is used as an end piece on the mouth side or as a central piece between two filter segments of a filter of a filter cigarette or a filter of a rod-shaped article of the tobacco processing industry. In this case, a rod-shaped article of the tobacco processing industry, in particular, is understood as a cigarette or respectively filter cigarette but also a cigarillo, a cigar, a HNB (Heat not Burn) product or an E-cigarette.

Embodiments are directed to a double-layered tube of the tobacco processing industry that includes a first material strip portion having a first width; a second material strip portion having a second width; and a positioning adhesive between the first and second material strip portions as glue applied over at least a substantial portion of an entire surface of one of the first and second material strip portions. The first and second material strip portions are wound around one another so that edges defining the first width abut each other to form one of a circular or oval shape and so that edges defining the second width abut each other to form one of a circular or oval shape. The circular or oval shape of the second material strip is arranged externally around the circular or oval shaped of the first material strip and the abutting edges of the first and second material strips are offset from each other in a circumferential direction. Thicknesses of the first and second material strip portions range from 38 μm to 160 μm, and an applied thickness of the positioning adhesive ranges from 10 μm to 80 μm.

In embodiments, the positioning adhesive can be applied as glue over the entire surface of one of the first and second material strip portions.

According to embodiments of the invention, at least one of: the thicknesses of the first and second material strip portions can range from 100 μm to 140 μm, and the applied thickness of the positioning adhesive can range from 10 μm to 40 μm. Further, at least one of the thickness of the first and second material strip portions can range from 120 μm to 130

μm, and the application thickness of the positioning adhesive can range from 15 μm to 30 μm.

In accordance with further embodiments, the double-layered tube can include a seam adhesive provided between the first and second material strip portions as glue applied over substantially the entire length with an application thickness of 40 μm to 120 μm. The seam adhesive may be provided with an application thickness of 60 μm to 100 μm.

In other embodiments, a weight of at least one of the first and second material strip portions may range from 27 g/m2 to 125 g/m2. Further, the weight of at least one of the first and second material strip portions can range from 60 g/m2 to 120 g/m2. Still, the weight of at least one of the first and second material strip portions may range from 70 g/m2 to 110 g/m2.

According to other embodiments, the offset of the abutting edges of the first and second material strip portions may be between 0.5 mm to 3 mm. Further, the offset of the abutting edges of the first and second material strip portions can be between 1.5 mm to 2.5 mm.

In accordance with still other embodiments of the invention, a ratio of the second width to the first width can be between 52 to 48. Moreover, the ratio of the second width to the first width may be between 50.5 to 49.5.

Embodiments of the invention are directed to a method for producing double-layered tubes of the tobacco processing industry. The method includes conveying a base material strip in the longitudinal axial direction of conveyance; longitudinal axial cutting of the base material strip into a first material strip having a first width and a second material strip having a second width; gluing at least the second material strip over at least a substantial portion of an entire surface of the second material strip by applying a positioning adhesive with an application thickness between 10 μm and 80 μm; combining the first and the second material strips so as to be superimposed and offset to one another, wherein in a region in which the first and the second material strips combined to be superimposed and offset, the material strips are adhesively bonded together; shaping the superimposed material strips into a tubular rod; and cutting the rod to length into double-layered tubes.

In embodiment of the method, the application thickness of the positioning adhesive can be between 10 μm and 40 μm. Further, the application thickness of the positioning adhesive may be between 15 μm and 30 μm.

According to further embodiments, the method can also include applying a seam adhesive to at least one region on the second material strip with an application thickness of 40 μm to 120 μm. The seam adhesive may be applied with an application thickness of 60 μm to 100 μm. Moreover, the seam adhesive can be applied at least one of before and after combining the material strips.

According to still other embodiments, the first material strip may be narrower than the second material strip, and the shaped second material strip can be arranged externally around the shaped first material strip. A ratio of a second width of the second material strip to a first width of the first material strip can be between 52 to 48. Further, the ratio of the second width to the first width can be between 50.5 to 49.5.

In accordance with still yet other embodiments of the present invention, a type of adhesive used for the positioning adhesive may be different from a type of adhesive is used for the seam adhesive.

Further features of the invention are disclosed from the description of embodiments according to the invention, together with the claims and the accompanying drawings. Embodiments according to the invention may fulfill individual features or a combination of a plurality of features.

BRIEF DESCRIPTION OF THE DRAWINGS

The invention is described hereinafter without limiting the general inventive idea using exemplary embodiments with reference to the drawings, wherein relative to all details according to the invention not described in more detail reference is expressly made to the drawings, in which.

In the drawings, the same or similar elements and/or parts are provided in each case with the same reference numerals so that in each case a further description is dispensed with.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
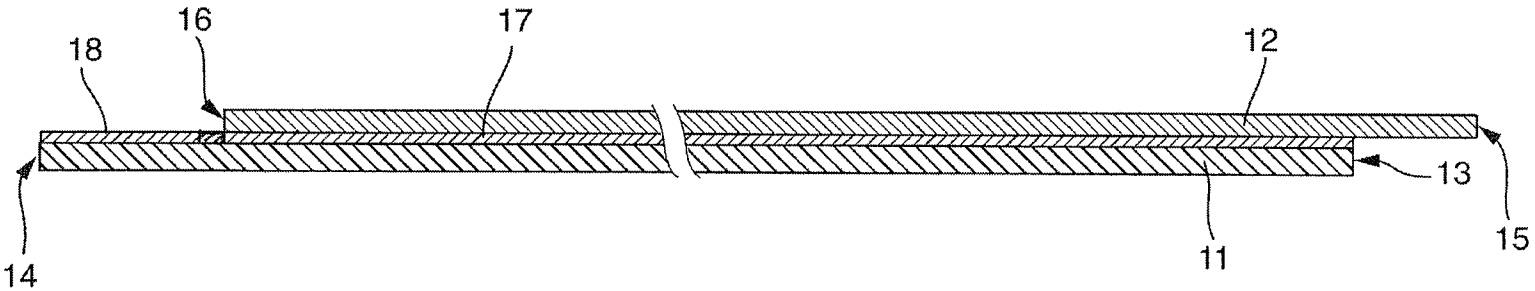
FIG. 1 shows a schematic sectional view through a double-layered material strip in a cutting plane transversely to the longitudinal axis of the material strips.

FIG. 1 shows, in a schematic sectional view transversely to the longitudinal axis of two material strips 11 and 12, the state of a first material strip 11 and of a second material strip 12 after these strips have been joined together. In this case, it may be seen that first material strip 11 has a positioning adhesive 17, for example a glue, on its upper face. Second material strip 12 is positioned onto positioning adhesive 17.

First material strip 11 has left and right edges 13 and 14 and second material strip 12 has left and right edges 15 and 16.

Additionally, a seam gluing (or seam glued strip) 18 may be undertaken on first material strip 11, which serves to provide an adhesive to the part of second material strip 12 extending beyond right edge 13 of first material strip 11. Seam glued strips may also be provided, for example, on one side of first material strip 11 and on an opposing side of material strip 11. Gluing 17 (or application of positioning adhesive 17) may take place at a same time as seam gluing 18 (or application of seam glue strip 18), or as already specified above, i.e., before the shaping of the tube or the tubular rod in a formatting apparatus.

Figure 2:
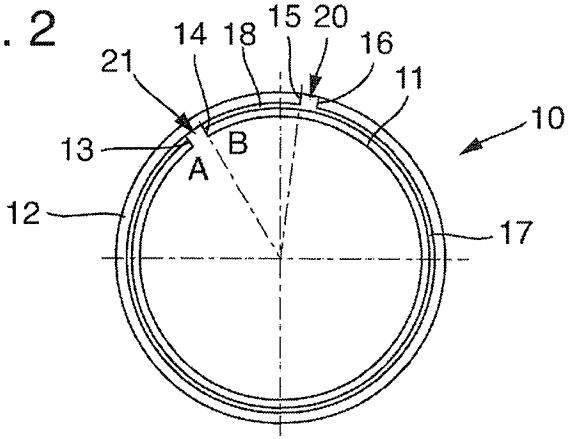
FIG. 2 shows a correspondingly produced double-layered tube according to the invention in a schematic sectional view.

After passing through the formatting apparatus, in this configuration a double-layered tubular rod 10 is produced or respectively after cutting this rod 10 to length a double-layered tube is produced, which is shown schematically in cross section in FIG. 2. In this case, first material strip portion 11 is located in an interior, whereby edges 13 and 14 are arranged either to abut each other or with a small spacing from one another in an abutting region 21.

Abutting region 21 is not aligned radially with (or is radially offset from in a circumferential direction) an abutting region 20 of second wrapping material strip 12, where edges 15 and 16 are arranged either to abut each other or with a small spacing from one another in an abutting region 20. The gaps of abutting regions 20 and 21 may also be provided with an adhesive. However, in the exemplary embodiment of FIG. 2, no adhesive is provided. In contrast to the prior art, an improved roundness is provided since there is no overlapping of left and right edges 15 and 16 of second wrapping material strip 12, but instead these edges are placed in an alignment to achieve a substantially circular outer contour.

By the offset of abutting regions 20 and 21 in the circumferential direction, a very secure closure is produced for double-layered tube 10. Moreover, as a result, an increased stability of double-layered tube 10 is achieved since the weakened points of individual layers 11, 12 are spaced apart from one another.

The thicknesses of first material strip portion 11 and of second material strip portion 12 may be of different sizes or substantially a same size relative to one another. With different thicknesses, it is preferred if the outer material strip portion, i.e., material strip portion 12, is thinner than first material strip portion 11. Preferred thicknesses according to the invention are described above.

Figure 3:
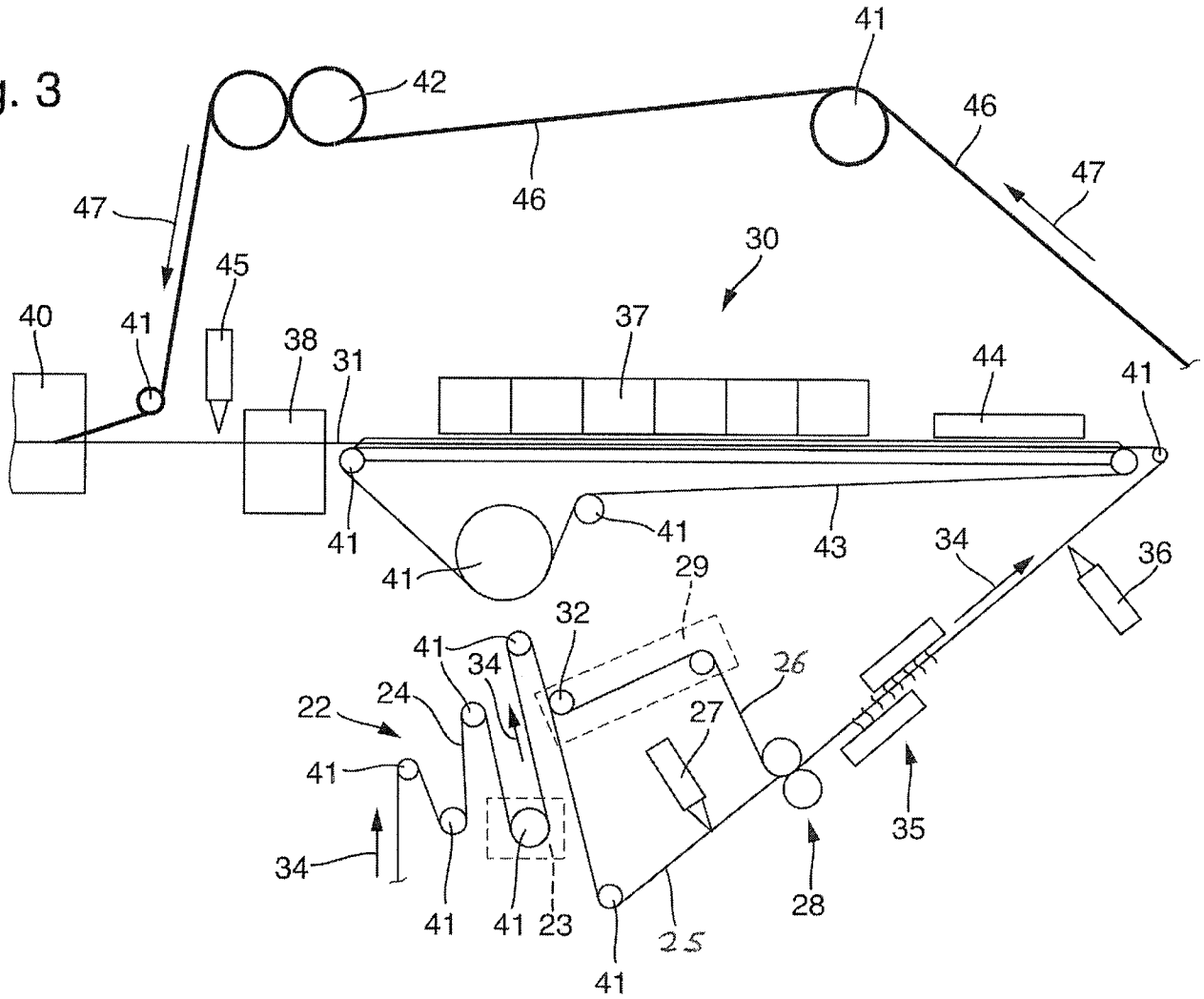
FIG. 3 shows an apparatus according to the invention for producing double-layered tubes in a schematic view and FIG. 4 shows a schematic sectional view through a filter which comprises a double-layered tube.

FIG. 3 shows schematically an apparatus according to the invention for producing double-layered tubes 10 of the tobacco processing industry. In this exemplary embodiment, a plurality of variants of the apparatus according to the invention is concurrently shown.

From a bobbin, not shown, a correspondingly wide base material strip 24 is drawn off in a direction of conveyance 34 and deflected via rollers 41 in a material strip supply apparatus 22. A cutting apparatus (cutter) 23, which can be a longitudinal cutter, follows material strip supply apparatus 22, to cut base material strip 24 in a longitudinal direction.

The cut material strip 24 produces a first material strip 25 and a second material strip 26, which are conveyed in parallel via a further deflection roller 41, in order to be separated from one another via a transverse conveyor 32 in the form of a deflection roller, whereby second material strip 26 is deflected out of the conveyance path of first material strip 25. After first material strip 25 is deflected by another deflection roller 41, first material strip 25 is substantially completely glued (or a positioning adhesive is applied thereto) via a gluing apparatus 27 at least over an entire length. This gluing apparatus 27 may, for example, omit the region of a seam but this does not necessarily have to be the case. In other embodiments, after a further deflection after transverse conveyor 32, second material strip 26 can be substantially completely glued via a gluing apparatus (not shown) at least over an entire length. Again, this gluing apparatus may also omit the region of a seam but does not necessarily have to.

After transverse conveyor 32, first material strip 25 is conveyed separately from second material strip 26. Moreover, via offsetting apparatus 29, first material strip 25 and second material strip 26 are offset in the transverse direction relative to s direction of conveyance so that in a traction roller pair 28, by which first material strip 25 is combined with second material strip 26, material strips 25 and 26 are superimposed or overlap so as to be laterally offset from one another. Material strips 25, 26 are present at this point, for example, as shown schematically in FIG. 1.

Subsequently, a heating apparatus 35 is provided, by which the applied glue or positioning adhesive 17 is pre-hardened. In embodiments in which seam gluing has already taken place, superimposed material strips 25 and 26 are supplied to a formatting apparatus 30. In embodiments in which seam gluing has not yet taken place, seam gluing can be effected or carried out via seam gluing apparatus 36, which is arranged between heating apparatus 35 and formatting apparatus 30.

In formatting apparatus 30, an intake finger 44 is configured and arranged to press the joined material strips 25, 26 downwardly onto a formatting unit belt 43, which is guided endlessly through formatting apparatus 30 via corresponding deflection rollers 41.

In formatting apparatus 30, joined material strips 25, 26 are shaped into a round shape or an oval shape in the known manner. An upper formatting unit according to this embodiment is configured as a heated upper formatting unit 37 in order to further set (harden) the glue or the applied positioning adhesive 17.

Subsequently, via an apparatus for cutting to length (tube cutter) 38, double-layered tubes are correspondingly cut to the desired length from the thus formed rod 31.

From here, a very rapid production is possible of corresponding tubes 10, which are cut to length from tubular rod 31 and then the glue or adhesive is ultimately cured (hardened) in rod-making machine 40, which can include a further heater (not shown in FIG. 3).

In alternative embodiments, rather than cutting tubular rod 31 exiting formatting apparatus 30 into double-length tubes, tubular rod 31 can be introduced into a rod-making machine 40. To this end, produced tubular rod 31 may be introduced into rod-making machine 40 to allow the glue or adhesive to cure (harden) further via heating.

Alternatively, for example, a filter tow 46 from a filter tow preparation apparatus (not shown in FIG. 3, but which would be arranged to the right of illustrated apparatus) may be guided above formatting unit 30 via the apparatus according to embodiments and supplied by a traction roller pair 42 in a direction of conveyance 47 to rod-making machine 40. Filter tow 46 may, for example, be arranged around the tubular rod 31.

To hold filter tow 46 on tubular rod 31, an adhesive, for example also PVA, is applied to tubular rod 31 via an anchoring seam apparatus 45. In rod-making machine 40, a wrapping material strip may be accordingly wound around the rod, which includes an internal tubular rod and a filter tow located externally around said rod, in a formatting apparatus and thus a corresponding filter may be produced.

Figure 4:
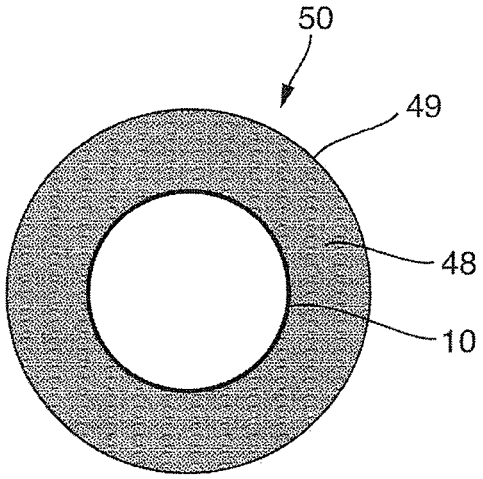

A suitable filter therefor is shown schematically in FIG. 4 by way of example. The filter in this case is provided with the reference numeral 50. Tube 10 is located on the inside, the filter tow 48 is located on the outside and a wrapping material 49 is arranged around said filter tow 48.

Gluing apparatus 27 and seam gluing apparatus 36 may be configured as flat nozzles, spin-spray nozzles or according to EP 2 974 798 A1, the disclosure of which is expressly incorporated by reference herein in its entirety. In this case, preferably a surface application of adhesive or glue is undertaken.

Heating apparatus 35 may be optionally provided. This serves substantially for pre-curing or pre-hardening the adhesive or glue.

For accurate alignment of the paper webs (material strips) relative to one another, in particular for adjusting the correct offset in the width thereof, corresponding sensors which identify the position of the edges of the material strips may be provided. Thus corresponding control mechanisms may be provided in order to control the position of the material strips relative to one another.

For simpler round shapes, in particular of thick paper or cardboard, the material strip may be pre-bent immediately upstream of the formatting apparatus or immediately downstream of the longitudinal cutter.

The double-layered tube may have an internal diameter of, for example, 3 mm to 8 mm.

All of the cited features and also the features to be derived individually from the drawings and also individual features which are disclosed in combination with other features, are regarded individually and in combination as essential to the invention. Embodiments according to the invention may be fulfilled by individual features or a combination of a plurality of features. Within the scope of the invention, features which are qualified by "in particular" or "preferably" are to be understood as optional features.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMERALS

10 Tube
11 First material strip portion
12 Second material strip portion
13 Edge
14 Edge
15 Edge
16 Edge
17 Positioning adhesive
18 Seam adhesive
20 Abutting region
21 Abutting region
22 Material strip supply apparatus
23 Cutting apparatus
24 Base material strip
25 First material strip
26 Second material strip
27 Gluing apparatus
28 Traction roller pair
29 Offsetting apparatus
30 Formatting apparatus
31 Rod
32 Transverse conveyor
34 Direction of conveyance
35 Heating apparatus
36 Seam gluing apparatus
37 Heated upper formatting unit
38 Apparatus for cutting to length
40 Rod-making machine
41 Deflection roller
42 Traction roller pair
43 Formatting unit belt
44 Intake finger
45 Anchoring seam application apparatus
46 Filter tow strip
47 Direction of conveyance
48 Filter tow
49 Wrapping material
50 Filter

What is claimed:

1. A double-layered tube of the tobacco processing industry, comprising:

a first material strip portion having a first width;

a second material strip portion having a second width; and a positioning adhesive between the first and second material strip portions as glue applied over at least a substantial portion of an entire surface of one of the first and second material strip portions, the first and second material strip portions being wound around one another so that edges defining the first width abut each other to form one of a circular or oval shape and so that edges defining the second width abut each other to form one of a circular or oval shape, wherein the circular or oval shape of the second material strip is arranged externally around the circular or oval shaped of the first material strip, wherein the abutting edges of the first and second material strips are offset from each other in a circumferential direction, and wherein thicknesses of the first and second material strip portions range from 38 μm to 160 μm, and an applied thickness of the positioning adhesive ranges from 10 μm to 80 μm.

2. The tube according to claim 1, wherein the positioning adhesive is applied as glue over the entire surface of one of the first and second material strip portions.

3. The tube according to claim 1, wherein at least one of:

the thicknesses of the first and second material strip portions range from 100 μm to 140 μm, and the applied thickness of the positioning adhesive ranges from 10 μm to 40 μm.

4. The tube according to claim 3, wherein at least one of:

the thickness of the first and second material strip portions ranges from 120 μm to 130 μm, and the application thickness of the positioning adhesive ranges from 15 μm to 30 μm.

5. The tube according to claim 1, further comprising a seam adhesive provided between the first and second material strip portions as glue applied over substantially the entire length with an application thickness of 40 μm to 120 μm.

6. The tube according to claim 5, wherein the seam adhesive is provided with an application thickness of 60 μm to 100 μm.

7. The tube according to claim 1, wherein a weight of at least one of the first and second material strip portions ranges from 27 $g/m^2$ to 125 $g/m^2$.

8. The tube according to claim 7, wherein the weight of at least one of the first and second material strip portions ranges from 60 $g/m^2$ to 120 $g/m^2$.

9. The tube according to claim 7, wherein the weight of at least one of the first and second material strip portions ranges from 70 $g/m^2$ to 110 $g/m^2$.

10. The tube according to claim 1, wherein the offset of the abutting edges of the first and second material strip portions is between 0.5 mm to 3 mm.

11. The tube according to claim 10, wherein the offset of the abutting edges of the first and second material strip portions is between 1.5 mm to 2.5 mm.

12. The tube according to claim 1, wherein a ratio of the second width to the first width is between 52 to 48.

13. The tube according to claim 12, wherein the ratio of the second width to the first width is between 50.5 to 49.5.

14. A method for producing double-layered tubes of the tobacco processing industry comprising:

conveying a base material strip in the longitudinal axial direction of conveyance;

longitudinal axial cutting of the base material strip into a first material strip having a first width and a second material strip having a second width;

gluing at least the second material strip over at least a substantial portion of an entire surface of the second material strip by applying a positioning adhesive with an application thickness between 10 μm and 80 μm;

combining the first and the second material strips so as to be superimposed and offset to one another, wherein in a region in which the first and the second material strips combined to be superimposed and offset, the material strips are adhesively bonded together;

shaping the superimposed material strips into a tubular rod; and cutting the rod to length into double-layered tubes.

15. The method according to claim 14, wherein the application thickness of the positioning adhesive is between 10 μm and 40 μm.

16. The method according to claim 14, wherein the application thickness of the positioning adhesive is between 15 μm and 30 μm.

17. The method according to claim 14, further comprising applying a seam adhesive to at least one region on the second material strip with an application thickness of 40 μm to 120 μm.

18. The method according to claim 17, wherein the seam adhesive is applied with an application thickness of 60 μm to 100 μm.

19. The method according to claim 17, wherein the seam adhesive is applied at least one of before and after combining the material strips.

20. The method according to claim 14, wherein the first material strip is narrower than the second material strip, and the shaped second material strip is arranged externally around the shaped first material strip, wherein a ratio of a second width of the second material strip to a first width of the first material strip is between 52 to 48.

21. The method according to claim 20, wherein the ratio of the second width to the first width is between 50.5 to 49.5.

22. The method according to claim 14, wherein a type of adhesive used for the positioning adhesive is different from a type of adhesive is used for the seam adhesive.

* * * * *